US006814601B2

(12) United States Patent
Lin

(10) Patent No.: US 6,814,601 B2
(45) Date of Patent: Nov. 9, 2004

(54) MICROPHONE CONNECTOR

(76) Inventor: Jia-Sheng Lin, P.O. Box 2-10, Tainan City (TW)

( * ) Notice: Subject to any disclaimer, the term of this patent is extended or adjusted under 35 U.S.C. 154(b) by 31 days.

(21) Appl. No.: 10/408,698

(22) Filed: Apr. 4, 2003

(65) Prior Publication Data

US 2004/0198087 A1 Oct. 7, 2004

(51) Int. Cl.[7] ..... H01R 13/62
(52) U.S. Cl. ..... 439/321
(58) Field of Search ..... 439/320–323

(56) References Cited

U.S. PATENT DOCUMENTS 4,285,564 A * 8/1981 Spinner ..... 439/321
4,422,710 A * 12/1983 Perona ..... 439/584
4,531,796 A * 7/1985 Gansert et al. ..... 439/589
6,086,400 A * 7/2000 Fowler ..... 439/321
6,113,410 A * 9/2000 Heit et al. ..... 439/321

* cited by examiner

*Primary Examiner*—Gary Paumen

(57) ABSTRACT

A microphone connector includes a body, a terminal base received in the body, an elastic hook fixed on the body, a cable constrictor, a compress ring, a rotatable constrict ring, and a rear body. The rotatable constrict ring is threadably combined with the body, possible to be rotated to force the compress ring move forward and closely contact with a microphone so as to connect the connector tightly with the microphone with the elastic hook impossible to be pressed to prevent the microphone from separating from the connector. Further, the rear body engages with the body, having a cable constrictor formed in an outer end to constrict a cable.

2 Claims, 6 Drawing Sheets

MICROPHONE CONNECTOR

FIELD OF THE INVENTION

This invention relates to a microphone connector, particularly to one capable to prevent the microphone connector from randomly separating from a microphone, and really keep the microphone from falling off the connector to cause damage to the microphone.

BACKGROUND OF THE INVENTION

A first conventional microphone connector shown in FIG. 1 includes a body 1, a terminal base 10 provided in the body 1 for receiving terminals 100, an elastic hook 11 combined on the body 1, a stop annular wall 12 formed integral with the body 1, male threads 13 formed on the stop annular wall 12, a constrict ring 14 having female threads 140 to engage with the male threads 13 to combine with the body 1, and a rear body 15 having female threads 150 to engage with the body 1 and a cable constrictor 16 for constrict a cable. The constrict ring 14 can prevent the elastic hook 11 from pressed.

However, the first conventional microphone connector has the body 1 provided with the stop annular wall 12, which may form a gap (d) between the connector and a microphone 17 after the microphone 17 is connected with the connector. This gap may hamper mutual tight combination of the both so that the microphone may sway owing to the gap (d), and subsequently fall off the connector to be damaged. Further the gap (d) forces the combined state of the microphone and the connector slant to look like untidy A second conventional microphone connector shown in FIG. 2 includes a body 2, a terminal base 20 for receiving terminals 200, an elastic hook 21 provided on the body 2, male threads 23, a constrict ring 24 having female threads 240 and a sloping surface 241 extending rearward from the male threads 240, and an inner annular surface 242 of a larger diameter extending rearward from the sloping surface 241. Then the constrict ring 24 threadably engages with the body 2 with the elastic hook 21 positioned in the constrict ring 24 so that the constrict ring 24 may move forward after a microphone is combined with the connector with the inner annular surface 242 forcing the elastic hook 21 tightly hook the microphone 17. Then the microphone 17 may be closely combined with the connector. In case the constrict ring 24 is moved rearward, the female threads 240 of the constrict ring 24 presses the elastic hook 21 to force the microphone 17 separate from the connector, and a rear fixing base 25 of the connector can be used for locking the connector on a flat surface of something like a table.

The second conventional microphone connector can keep a microphone in a stable condition, with the constrict ring 24, but it is more suitable for a fix-style microphone, and its elastic hook 21 may soon lose its elasticity by frequent use, possibly causing the microphone to fall off the connector.

SUMMARY OF THE INVENTION

This invention has been devised to offer a microphone connector improved in the above-mentioned disadvantages. The microphone connector has the following features.

1. It uses a rotatable constrict ring rotated to move forward to constrict a microphone tightly and keeping the elastic hook from pressed and subsequently preventing the microphone from falling off the connector.

2. It has a body, a terminal base, an elastic hook, a guide annular wall and male threads provided in the body, and a compress ring having a lateral gap and combined with the guide annular wall in a definite direction.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
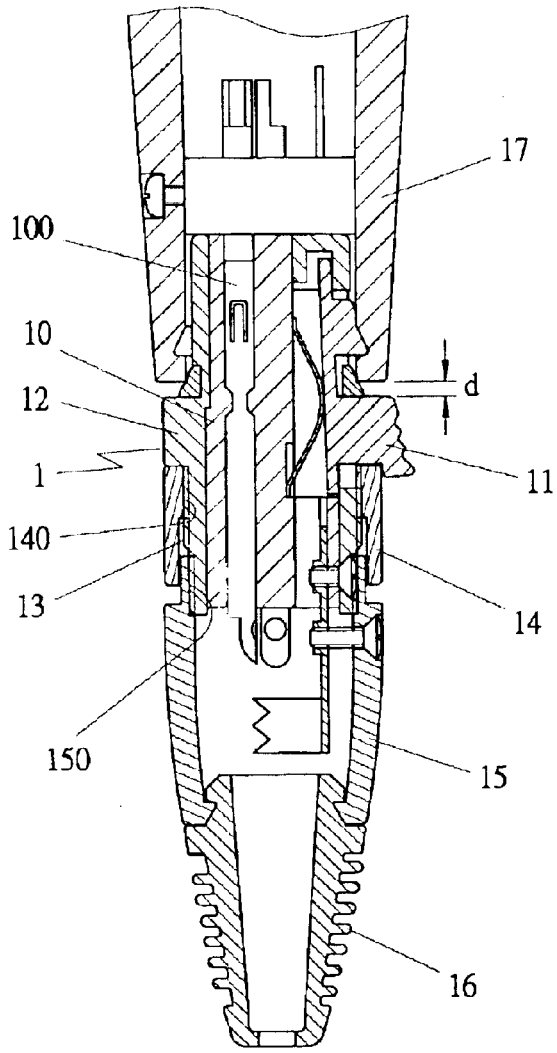
FIG 1 (PRIOR ART)
FIG. 1 is a cross-sectional view of a first conventional microphone connector connected with a microphone.
Figure 2:
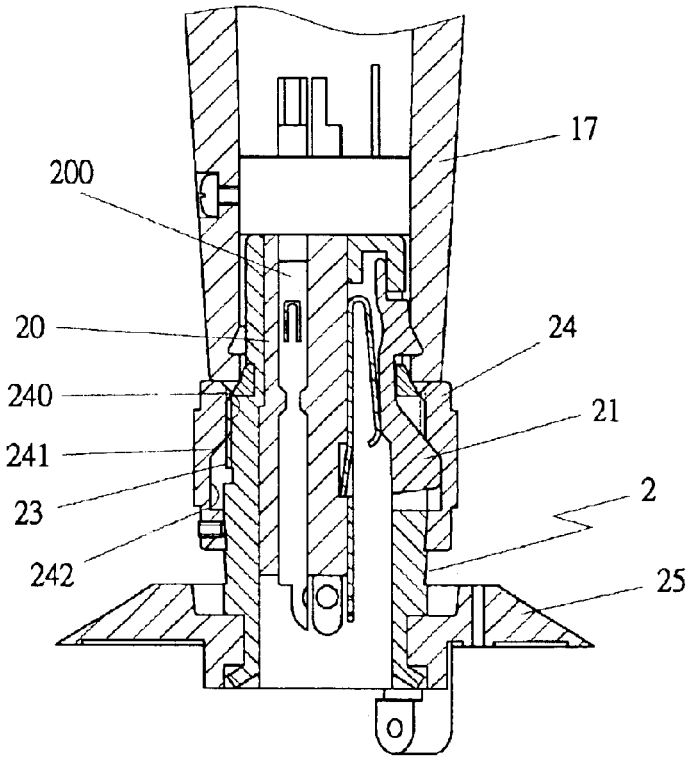
FIG 2 (PRIOR ART)
FIG. 2 is a cross-sectional view of a second conventional microphone connector connected with a microphone.
Figure 3:
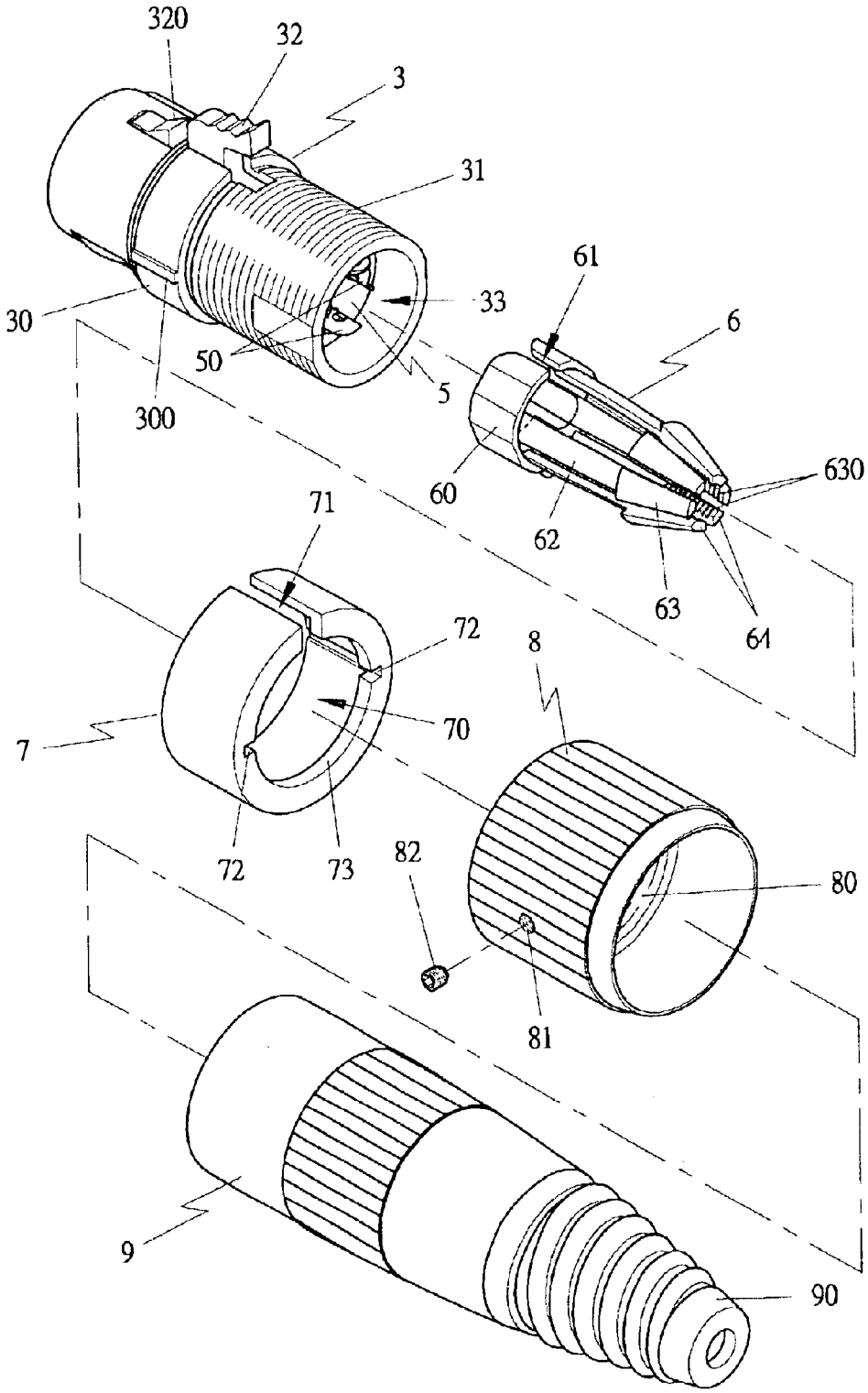
FIG. 3 is an exploded perspective view of a first embodiment of a microphone connector in the present invention.
Figure 5:
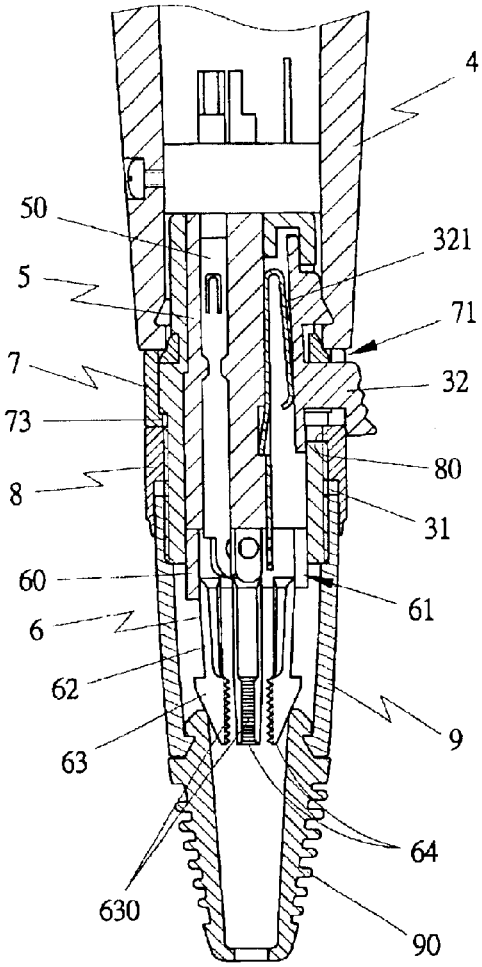
FIG. 5 is a cross-sectional view of the first embodiment of a microphone connector connected with a microphone in the present invention.
Figure 4:
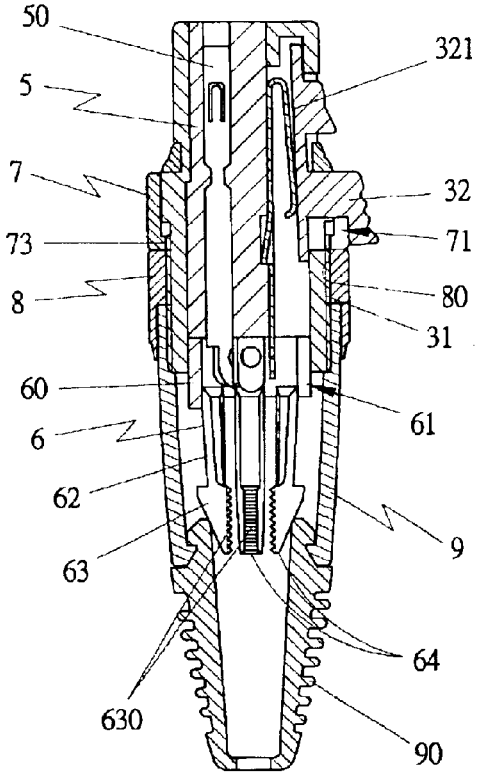
FIG. 4 is a cross-sectional view of the first embodiment of a microphone connector in the present invention.

A preferred embodiment of a microphone connector in the present invention, as show in FIGS. 3, 4 and 5, includes a body 3, a terminal base 5, a cable constrictor 6, a compress ring 7, a rotatable constrict ring 8 and a rear body 9 as main components combined together.

The body 3 is provided integral with an intermediate guide annular wall 30 having two lateral guide projecting edges 300 and a rear male threaded portion 31 behind the intermediate guide annular wall 3 to engage with a rotatable constrict ring 8 and a rear body 9. An elastic hook 32 is combined on the body 3, having a front-end portion 320 to combine with a microphone 4 or another connector. The elastic hook 32 has elasticity for opening and closing in conjunction with the elastic members 321 fixed on the terminal base 5 to move with the elastic hook 32 to supply the elastic hook 32 with elasticity. The body 3 has a center hole 33 for receiving the terminal base 5 therein.

The terminal base 5 has a plurality of terminals 50, fitted stably in the center hole 33 of the body 3, with the terminals 50 having their ends welded with lead wires.

The cable constrictor 6 has a front annular wall 60 of multi-sides and with a round inner hole of a glossy surface, and 10 the front annular wall 60 has a lateral gap 61 for receiving an end of a terminal 50 of the terminal base 5, an intermediate annular wall 62 of a small diameter behind the rear annular wall 60, and a rear tapering annular wall 63 having an inner toothed surface 630 advantageous for constricting a cable. Further, the intermediate and the rear sloping annular wall 62 and 63 are consisted respectively of six pinching posts 64, which can reduce anti-expansion force to save force in constricting a cable. In addition, the intermediate annular wall 62 is recessed so that its inner surface may partly contact with the outer surface of a cable and subsequently more tightly constricting the cable by means of surface contact.

The compress ring 7 has a center hole 70 to fit around the annular guide wall 30 of the body 3, a lateral gap 71 for receiving a lower portion of the elastic hook 32 therein to permit the elastic hook 32 to move back and forth therein. The compress ring 7 further has two opposite lateral guide grooves 72 formed in an inner annular surface to fit with the lateral guide projecting edges 300 of the body 3 to let the compress ring 7 move in a definite direction, and a small diameter annular edge 73 formed in the inner annular surface to limit the moving distance of the compress ring 7.

The rotatable constrict ring 8 has partial female threads 80 to engage with the male threads 31 of the body 3. When the rotatable constrict ring 8 is rotated after combined with the body 3, it force the compress ring 7 move inward to closely contact the rear end of a microphone 4, leaving no gap at all, as shown in FIG. 5. Then the connector can tightly combine with the microphone 4, with the elastic hook 32 no longer able to be pressed, preventing the microphone 4 from separating from the connector. Further, the rotatable constrict ring 8 has a threaded hole 81 through the annular wall for a screw 82 to screw therein to lock the connector with the microphone 4 after combined together and limit rotation of the rotatable constrict ring and preventing the microphone 4 from separating from the connector at random.

The rear body 9 has female threads to engage with the body 3, and a constrict member 90 formed in an outer end for constricting a cable.

The microphone connector in the invention utilizes the rotatable constrict ring 8 to produce tightening function to effect close combination of a connector with a microphone, at the same time preventing the elastic hook from incidentally pressed so as not to let a microphone separate at random from the connector and also to lengthen service life of a microphone.

Figure 6:
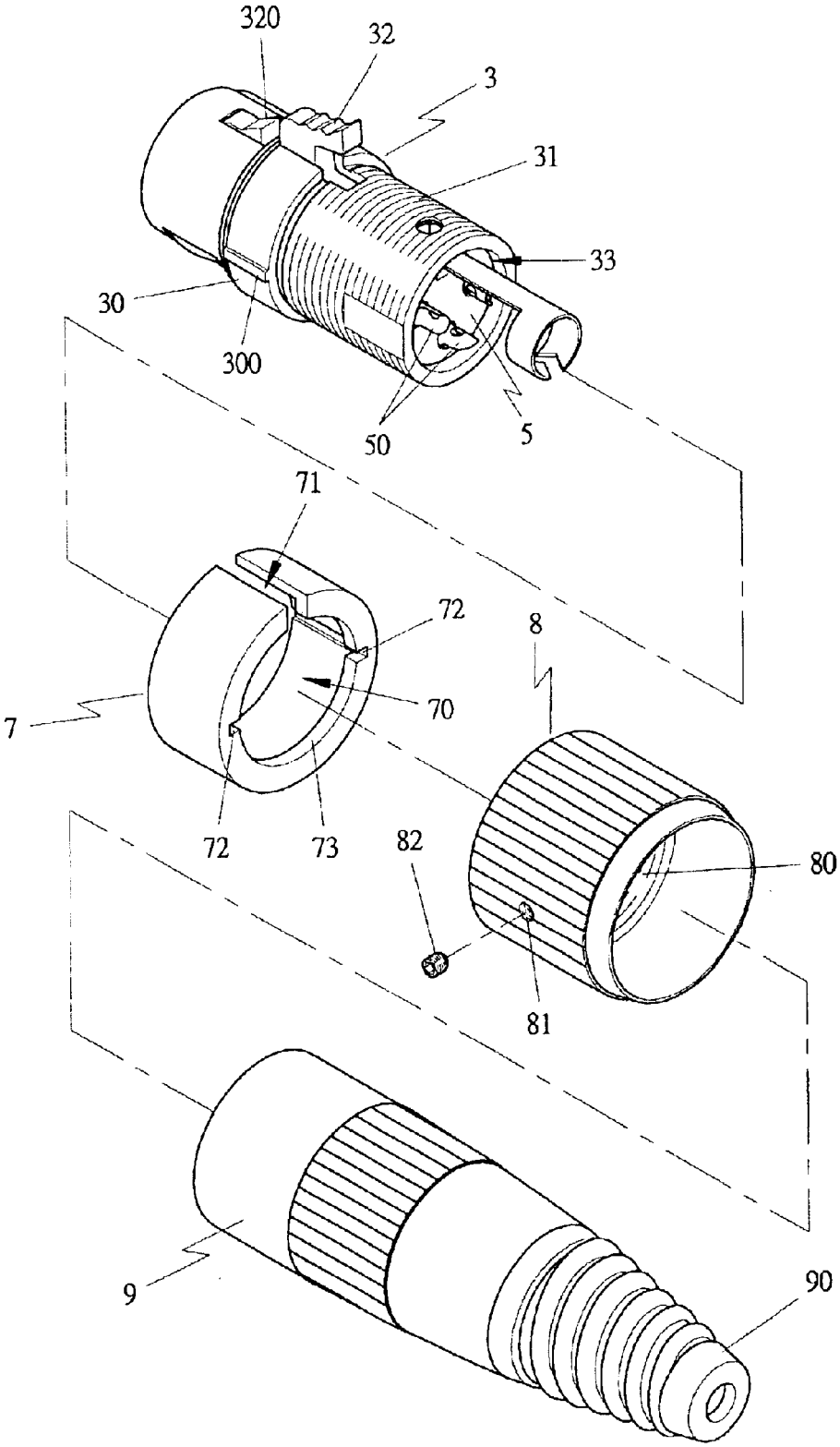
FIG. 6 is an exploded perspective view of a second embodiment of a microphone connector in the present invention.
Figure 8:
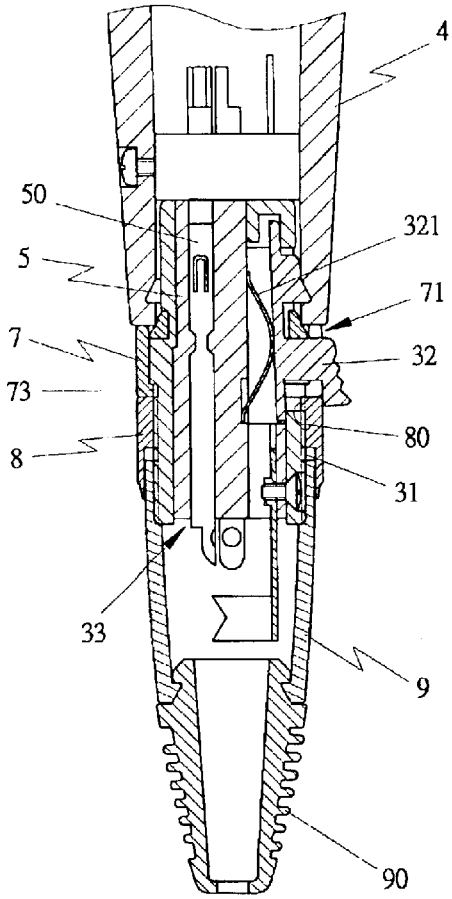
Figure 7:
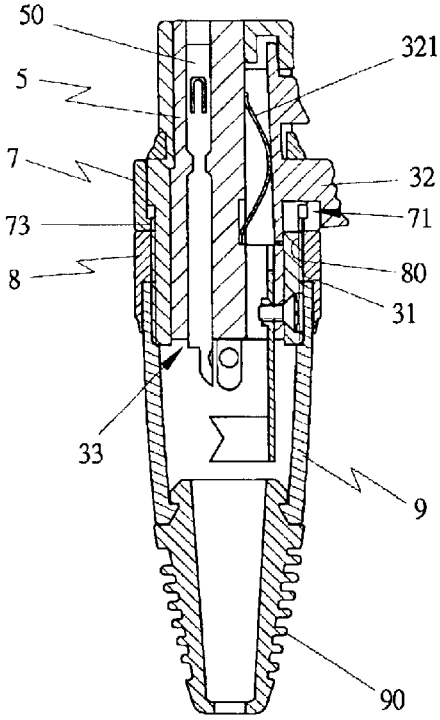
FIG. 7 is a cross-sectional view of the second embodiment of a microphone connector in the present invention; and, FIG. 8 is a cross-sectional view of the second embodiment of a microphone connector connected with a microphone in the present invention.

Next, FIGS. 6, 7 and 8 show a second embodiment of a microphone connector in the invention, which includes a body 3, a terminal base 5, a compress ring 7, a rotatable ring 8 and a rear body 9 as main components combined together, without the cable constrictor 6 in the first embodiment.

The body 3 is provided integral with an intermediate guide annular wall 30 having two opposite lateral guide projecting edges 300 and a rear male threaded wall 31 to threadably combine with the rotatable constrict ring 8 and the rear body 9, and an elastic hook 32 with a front end portion 320 to combine with a microphone 4 or another connector. The elastic hook 32 has elasticity for closing and opening in conjunction with the elastic members 320 fixed on the terminal base 5, and the body 3 has a center hole 33 for receiving the terminal base 5 therein.

The terminal base 5 has a plurality of terminals 50, inserted in the center hole 33 of the body 3 from one side, with the terminals 50 having their ends welded with lead wires.

The compress ring 7 has a center hole 70 to fit around the guide annular wall 30 of the body 3, having a lateral gap 71 for receiving the lower portion of the elastic hook 32 therein to permit the elastic hook 32 to move back and forth therein. The compress ring 7 further has two opposite inner lateral guide grooves 72 to fit with the two lateral guide projecting edges 300 of the body 3 to let the compress ring 7 move in the definite direction, and a small diameter inner annular surface 73 to limit the moving distance of the compress ring 7.

The rotatable constrict ring 8 has partial female threads 80 to engage with the male threads 31 of the body 3. When the rotatable constrict ring 8 is rotated after engaged with the body 3, it can force the compress ring 7 to move forward and tightly contact with the rear end of a microphone 4, leaving no gap between them at all, as shown in FIG. 8. Therefore, the connector and the microphone 4 are combined tightly together, with the elastic hook 32 no longer able to be pressed, preventing the microphone 4 from separating from the connector randomly. Further, the rotatable ring 8 has a threaded hole through its annular wall for a screw 82 to lock the connector with the microphone 4, limiting rotation of the rotatable constrict ring 8 and preventing the microphone 4 from separating from the connector at random.

The rear body 9 has female threads to engage with the body 3, and a constrict member 90 formed in its outer end for tightly catching a cable.

Thus the second embodiment of a microphone connector also utilizes the movable constrict ring 8 for forcing the compress ring 7 closely contact the rear end of a microphone 4 so that the microphone and the connector are closely and tightly combined together, not only preventing the elastic hook not incidentally pressed but also hampering the microphone separate from the connector randomly, lengthening service life of a microphone.

While the preferred embodiments of the invention have been described above, it will be recognized and understood that various modifications may be made therein and the appended claims are intended to cover all such modifications that may fall within the spirit and scope of the invention.

What is claimed is:

1. A microphone connector comprising:

a body provided integral with an intermediate guide annular wall, said intermediate guide annular wall having two opposite lateral projecting edges, a rear male threaded wall for threadably engaging with a rotatable constrict ring and a rear body, an elastic hook combined with said body and having a front end portion to combine with a microphone or another connector, and said body further having a center hole for receiving a terminal base therein;

said terminal base having a plurality of terminals and positioned in said center hole of said body from one side;

a cable constrictor for constricting a cable;

a compress ring having center hole for fitting around said intermediate annular guide wall of said body, a lateral gap for the lower portion of said elastic hook to fit movably therein, two lateral guide grooves formed in an inner annular surface to fit with said two lateral guide projecting edges of said body to let said compress ring to move in a definite direction;

said rotatable constrict ring provided with female threads engaging with said male threads of said body, said rotatable constrict ring rotated to force said compress ring move forward to compel said compress ring closely contact the rear end of a microphone so that the connector may tightly connected with the microphone; said constrict rotating ring further having a threaded hole through an annular wall for a screw to lock said rotating constrict ring to limit rotation of said constrict rotating ring, thus preventing said microphone from separating from said connector; and, said rear body having female threads engaging with said body, and a cable constrictor formed in an outer end for constricting a cable.

2. The microphone connector as claimed in claim 1, wherein said compress ring has an inner small-diameter annular wall to limit said compress ring in moving forward.

* * * * *